US011241596B2

(12) United States Patent
Kling

(10) Patent No.: US 11,241,596 B2
(45) Date of Patent: Feb. 8, 2022

(54) BREATHING MASK AND FLUSHING ARRANGEMENT FOR A BREATHING MASK

(71) Applicant: MSA Europe GmbH, Jona (CH)

(72) Inventor: Peter Kling, Berlin (DE)

(73) Assignee: MSA Europe GmbH, Jona (CH)

( * ) Notice: Subject to any disclaimer, the term of this patent is extended or adjusted under 35 U.S.C. 154(b) by 597 days.

(21) Appl. No.: 15/557,342

(22) PCT Filed: Feb. 15, 2016

(86) PCT No.: PCT/EP2016/053175
§ 371 (c)(1),
(2) Date: Sep. 11, 2017

(87) PCT Pub. No.: WO2016/146324
PCT Pub. Date: Sep. 22, 2016

(65) Prior Publication Data

US 2018/0050228 A1 Feb. 22, 2018

(30) Foreign Application Priority Data

Mar. 13, 2015 (DE) ..... 10 2015 204 645.1

(51) Int. Cl.
*A62B 18/10* (2006.01)
*A62B 18/02* (2006.01)

(52) U.S. Cl.
CPC ..... *A62B 18/10* (2013.01); *A62B 18/02* (2013.01)

(58) Field of Classification Search
CPC .... A62B 7/00; A62B 7/04; A62B 7/14; A62B 9/02; A62B 9/022; A62B 9/025;
(Continued)

(56) References Cited

U.S. PATENT DOCUMENTS 2,684,066 A * 7/1954 Glidden ..... A62B 9/02 128/205.24
3,680,555 A * 8/1972 Warncke ..... A62B 18/10 128/206.24
(Continued)

FOREIGN PATENT DOCUMENTS

DE 1708045 A1 1/1972
DE 10159219 A1 6/2003
(Continued)

*Primary Examiner* — Valerie L Woodward
*Assistant Examiner* — Paige Kathleen Bugg
(74) *Attorney, Agent, or Firm* — The Webb Law Firm

(57) ABSTRACT

A breathing mask, including a mask body having an inner area; a breathing valve configured to control the flow of breathing gas into the inner area of the mask body, the breathing valve comprising a membrane having an outer surface; and a flushing arrangement, comprising: a flushing area located adjacent the outer surface of the membrane; at least one exhalation chamber configured to receive exhaled air from the inner area of the breathing mask; and at least one channel fluidly connecting the flushing area and the at least one exhalation chamber; wherein, during user inhalation, air from the at least one exhalation chamber flows through the at least one channel into the flushing area, and during user exhalation, air from the flushing area flows through the at least one channel into the at least one exhalation chamber.

20 Claims, 4 Drawing Sheets

(58) Field of Classification Search
CPC ..... A62B 9/027; A62B 18/00; A62B 18/02; A62B 18/025; A62B 18/06; A62B 18/08; A62B 18/10; A61M 16/06; A61M 16/20; A61M 16/201; A61M 16/206; A61M 16/207; A61M 16/208; A61M 16/209; A61M 16/204; A61M 16/205; B63C 11/00; B63C 11/12
USPC ..... 128/207.12
See application file for complete search history.

(56) References Cited

U.S. PATENT DOCUMENTS

| | | | | |
|---|---|---|---|---|
| 4,572,177 | A * | 2/1986 | Tiep | A61M 16/0677 128/205.17 |
| 6,892,725 | B2 | 5/2005 | Frund | |
| 8,245,712 | B2 * | 8/2012 | Kling | A62B 18/10 128/207.12 |
| 8,336,547 | B1 * | 12/2012 | Ritchie | A62B 18/10 128/204.29 |
| 2005/0066966 | A1 * | 3/2005 | King | A62B 18/10 128/201.23 |
| 2010/0147306 | A1 * | 6/2010 | Townsend | A62B 18/10 128/204.26 |

FOREIGN PATENT DOCUMENTS

| | | | |
|---|---|---|---|
| FR | 1490549 | | 8/1967 |
| GB | 1215218 | A | 12/1970 |
| WO | 2004052464 | A1 | 6/2004 |

* cited by examiner

BREATHING MASK AND FLUSHING ARRANGEMENT FOR A BREATHING MASK

CROSS REFERENCE TO RELATED APPLICATIONS

This application is the United States national phase of International Application No. PCT/EP2016/053175 filed Feb. 15, 2016, and claims priority to German Patent Application No. 10 2015 204 645.1 filed Mar. 13, 2015, the disclosures of which are hereby incorporated in their entirety by reference.

BACKGROUND OF THE INVENTION

Field of the Invention

This invention relates generally to breathing masks, such as breathing masks used in connection with a compressed-air breathing apparatus, and in particular to a breathing mask having a breathing valve with a membrane for controlling inhalation and exhalation, as well as a flushing arrangement for such a breathing mask.

Description of the Related Art

Breathing masks are used in a variety of situations and environments, such as in firefighting activities, where such masks are used in connection with a compressed-air breathing apparatus, e.g., a self-contained breathing apparatus (SCBA). Certain breathing masks include a breathing valve with a membrane that is used to control and regulate the inhalation and exhalation of air to and from the air tank. Further, this membrane may be flushed, which is a known process (as described, for example, in German Patent No. 101 59 219 A1). According to this known process, one side of the membrane is flushed by exhaled air, and the exhaled air is expelled into the environment through air outlet openings directly in the region of the membrane. Upon inhalation, ambient air is drawn in through the air outlet openings into the immediate region before the membrane.

Therefore, it is desirous to provide an improved breathing mask having such a breathing valve with a membrane. In addition, it is desirous to provide an arrangement that leads to improved protection of the membrane. Further, it is desirous to provide an improved flushing arrangement for a breathing mask.

SUMMARY OF THE INVENTION

Generally, provided is an improved breathing mask for use in connection with a compressed-air breathing apparatus, such as a self-contained breathing apparatus. Preferably, provided is an improved breathing mask having a breathing valve with a membrane. Preferably, provided is an improved breathing mask that provides protection of the membrane of the breathing valve through the use of an improved flushing arrangement.

In one preferred and non-limiting embodiment or aspect, provided is a breathing mask, comprising: a mask body having an inner area; a breathing valve configured to control the flow of breathing gas into the inner area of the mask body, the breathing valve comprising a membrane having an outer surface; and a flushing arrangement, comprising: (i) a flushing area located adjacent the outer surface of the membrane; (ii) at least one exhalation chamber configured to receive exhaled air from the inner area of the breathing mask; and (iii) at least one channel fluidly connecting the flushing area and the at least one exhalation chamber; wherein, during user inhalation, air from the at least one exhalation chamber flows through the at least one channel into the flushing area, and during user exhalation, air from the flushing area flows through the at least one channel into the at least one exhalation chamber.

In one preferred and non-limiting embodiment or aspect, the membrane is flexible or deformable and configured to flex or deform between an initial position, an inhalation position, and an exhalation position. In another preferred and non-limiting embodiment or aspect, the volume of the flushing area when the membrane is in the inhalation position is greater than the volume of the flushing area when the membrane is in the initial position. In another preferred and non-limiting embodiment or aspect, the volume of the flushing area when the membrane is in the exhalation position is smaller than the volume of the flushing area when the membrane is in the initial position. In another preferred and non-limiting embodiment or aspect, the volume of the flushing area when the membrane is in the inhalation position is smaller than the volume of the at least one exhalation chamber.

In one preferred and non-limiting embodiment or aspect, the breathing mask further comprises at least one tensioning element configured to urge against at least one of the following: the membrane, at least one exhalation valve configured to facilitate one-way airflow from the inner area of the breathing mask into the at least one exhalation chamber, or any combination thereof.

In one preferred and non-limiting embodiment or aspect, the flushing area is defined by at least a portion of the outer surface of the membrane and at least a portion of a cover.

In one preferred and non-limiting embodiment or aspect, the breathing mask further comprises at least one exhalation valve configured to facilitate one-way airflow from the inner area of the breathing mask into the at least one exhalation chamber.

In one preferred and non-limiting embodiment or aspect, the exhalation chamber further comprises at least one exhalation opening through which exhaled air in the exhalation chamber flows to an outside environment.

In one preferred and non-limiting embodiment or aspect, provided is a flushing arrangement for a breathing mask having a breathing valve with a membrane for controlling inhalation and exhalation, the flushing arrangement comprising: a flushing area located adjacent an outer surface of the membrane; at least one exhalation chamber configured to receive exhaled air from the breathing mask; and at least one channel fluidly connecting the flushing area and the at least one exhalation chamber; wherein, during user inhalation, air from the at least one exhalation chamber flows through the at least one channel into the flushing area, and during user exhalation, air from the flushing area flows through the at least one channel into the at least one exhalation chamber.

In one preferred and non-limiting embodiment or aspect, the flushing area is defined by at least a portion of the outer surface of the membrane and at least a portion of a cover. In another preferred and non-limiting embodiment or aspect, the cover is integral with or connectable to at least a portion of the breathing valve of the breathing mask.

In one preferred and non-limiting embodiment or aspect, the membrane is flexible or deformable and configured to flex or deform between an initial position, an inhalation position, and an exhalation position. In another preferred and non-limiting embodiment or aspect, the volume of the flushing area when the membrane is in the inhalation position is greater than the volume of the flushing area when the membrane is in the initial position. In another preferred and non-limiting embodiment or aspect, the volume of the flushing area when the membrane is in the exhalation position is smaller than the volume of the flushing area when the membrane is in the initial position. In another preferred and non-limiting embodiment or aspect, the volume of the flushing area when the membrane is in the inhalation position is smaller than the volume of the at least one exhalation chamber.

In one preferred and non-limiting embodiment or aspect, the flushing arrangement further comprises at least one tensioning element configured to urge against at least one of the following: the membrane, at least one exhalation valve configured to facilitate one-way airflow from the inner area of the breathing mask into the at least one exhalation chamber, or any combination thereof.

In one preferred and non-limiting embodiment or aspect, the flushing arrangement further comprises at least one exhalation valve configured to facilitate one-way airflow from the inner area of the breathing mask into the at least one exhalation chamber.

In one preferred and non-limiting embodiment or aspect, the exhalation chamber further comprises at least one exhalation opening through which exhaled air in the exhalation chamber flows to an outside environment.

In one preferred and non-limiting embodiment or aspect, with the volume of the at least one exhalation chamber is in the range of about 10 $cm^3$ to about 30 $cm^3$.

In one preferred and non-limiting embodiment or aspect, shielding of the membrane can be improved by generating a pendular flow of air between at least one exhalation chamber located adjacent an exhalation valve and a flushing area located adjacent an outer surface of the membrane. The flushing area and the at least one exhalation chamber are connected with each other (preferably in an air-ducting manner only) via at least one channel. Accordingly, the flushing area does not have any direct openings to the outside environment, and air, e.g., exhaled air, can alternate between the at least one exhalation chamber and the flushing area.

In one preferred and non-limiting embodiment or aspect, the at least one exhalation chamber is arranged adjacent the exhalation valve of the breathing mask, and the at least one channel fluidly connects the at least one exhalation chamber with the flushing area, such that the membrane can be flushed (or ventilated) by at least a portion of the exhaled air in the exhalation chamber. In this embodiment or aspect, the air can enter into or exit from the at least one exhalation chamber only by way of the at least one channel, such that a pendular airflow is effected through the at least one channel during user inhalation (i.e., a flow of exhaled air from the exhalation chamber into the flushing area) and user exhalation (i.e., a flow of air from the flushing area into the exhalation chamber).

In one preferred and non-limiting embodiment or aspect, the flushing area is defined or formed by the membrane and, at least partly, by a covering cap. This cover (or cap) leads to the improved protection of the membrane.

In one preferred and non-limiting embodiment or aspect, and upon inhalation, the flushing area is smaller in its maximum volume than the volume of the at least one exhalation chamber. Such an arrangement ensures that freshly-exhaled air alternates. In another preferred and non-limiting embodiment or aspect, the volume of the at least one exhalation chamber is in the range of about 10 $cm^3$ to about 30 $cm^3$, and in another preferred and non-limiting embodiment or aspect, in the range of about 10 $cm^3$ to about 20 $cm^3$.

In one preferred and non-limiting embodiment or aspect, the cover is formed airtight with respect to the surroundings in at least the region of the flushing area, such that no gas can enter directly from the outside environment. In another preferred and non-limiting embodiment or aspect, the cover can be integral with or connectable to at least a portion of the breathing valve. In one preferred and non-limiting embodiment or aspect, the at least one exhalation chamber includes at least one exhalation opening to facilitate airflow to the outside environment.

Further preferred and non-limiting embodiments or aspects of the present invention are described in the following numbered clauses:

Clause 1: A breathing mask, comprising: a mask body having an inner area; a breathing valve configured to control the flow of breathing gas into the inner area of the mask body, the breathing valve comprising a membrane having an outer surface; and a flushing arrangement, comprising: (i) a flushing area located adjacent the outer surface of the membrane; (ii) at least one exhalation chamber configured to receive exhaled air from the inner area of the breathing mask; and (iii) at least one channel fluidly connecting the flushing area and the at least one exhalation chamber; wherein, during user inhalation, air from the at least one exhalation chamber flows through the at least one channel into the flushing area, and during user exhalation, air from the flushing area flows through the at least one channel into the at least one exhalation chamber.

Clause 2: The breathing mask of clause 1, wherein the membrane is flexible or deformable and configured to flex or deform between an initial position, an inhalation position, and an exhalation position.

Clause 3: The breathing mask of clause 1 or 2, wherein the volume of the flushing area when the membrane is in the inhalation position is greater than the volume of the flushing area when the membrane is in the initial position.

Clause 4: The breathing mask of any of clauses 1-3, wherein the volume of the flushing area when the membrane is in the exhalation position is smaller than the volume of the flushing area when the membrane is in the initial position.

Clause 5: The breathing mask of any of clauses 1-4, wherein the volume of the flushing area when the membrane is in the inhalation position is smaller than the volume of the at least one exhalation chamber.

Clause 6: The breathing mask of any of clauses 1-5, further comprising at least one tensioning element configured to urge against at least one of the following: the membrane, at least one exhalation valve configured to facilitate one-way airflow from the inner area of the breathing mask into the at least one exhalation chamber, or any combination thereof.

Clause 7: The breathing mask of any of clauses 1-6, wherein the flushing area is defined by at least a portion of the outer surface of the membrane and at least a portion of a cover.

Clause 8: The breathing mask of any of clauses 1-7, further comprising at least one exhalation valve configured to facilitate one-way airflow from the inner area of the breathing mask into the at least one exhalation chamber.

Clause 9: The breathing mask of any of clauses 1-8, wherein the exhalation chamber further comprises at least one exhalation opening through which exhaled air in the exhalation chamber flows to an outside environment.

Clause 10: A flushing arrangement for a breathing mask having a breathing valve with a membrane for controlling inhalation and exhalation, the flushing arrangement comprising: a flushing area located adjacent an outer surface of the membrane; at least one exhalation chamber configured to receive exhaled air from the breathing mask; and at least one channel fluidly connecting the flushing area and the at least one exhalation chamber; wherein, during user inhalation, air from the at least one exhalation chamber flows through the at least one channel into the flushing area, and during user exhalation, air from the flushing area flows through the at least one channel into the at least one exhalation chamber.

Clause 11: The flushing arrangement of clause 10, wherein the flushing area is defined by at least a portion of the outer surface of the membrane and at least a portion of a cover.

Clause 12: The flushing arrangement of clauses 10 or 11, wherein the cover is integral with or connectable to at least a portion of the breathing valve of the breathing mask.

Clause 13: The flushing arrangement of any of clauses 10-12, wherein the membrane is flexible or deformable and configured to flex or deform between an initial position, an inhalation position, and an exhalation position.

Clause 14: The flushing arrangement of any of clauses 10-13, wherein the volume of the flushing area when the membrane is in the inhalation position is greater than the volume of the flushing area when the membrane is in the initial position.

Clause 15: The flushing arrangement of any of clauses 10-14, wherein the volume of the flushing area when the membrane is in the exhalation position is smaller than the volume of the flushing area when the membrane is in the initial position.

Clause 16: The flushing arrangement of any of clauses 10-15, wherein the volume of the flushing area when the membrane is in the inhalation position is smaller than the volume of the at least one exhalation chamber.

Clause 17: The flushing arrangement of any of clauses 10-16, further comprising at least one tensioning element configured to urge against at least one of the following: the membrane, at least one exhalation valve configured to facilitate one-way airflow from an inner area of the breathing mask into the at least one exhalation chamber, or any combination thereof.

Clause 18: The flushing arrangement of any of clauses 10-17, further comprising at least one exhalation valve configured to facilitate one-way airflow from an inner area of the breathing mask into the at least one exhalation chamber.

Clause 19: The flushing arrangement of any of clauses 10-18, wherein the exhalation chamber further comprises at least one exhalation opening through which exhaled air in the exhalation chamber flows to an outside environment.

Clause 20: The flushing arrangement of any of clauses 10-19, wherein the volume of the at least one exhalation chamber is in the range of about 10 $cm^3$ to about 30 $cm^3$.

Still further preferred and non-limiting embodiments or aspects of the present invention are described in the following numbered clauses:

Clause 1: A breathing mask for a compressed-air breathing apparatus, with a breathing valve which includes a membrane for controlling the inhalation and exhalation, comprising means for generating a pendular flow between at least one antechamber before an exhalation valve and a membrane outer space, which in a gas-ducting, in particular air-ducting manner, are connected with each other only via at least one antechamber channel.

Clause 2: The breathing mask of clause 1, wherein the at least one antechamber is arranged before an exhalation valve and via the at least one antechamber channel is connected with the membrane outer space, so that on the side of the membrane outer space, the membrane can be ventilated, in particular, be flushed, by a part of the exhaled air from the antechamber, wherein air can enter into or exit from the at least one antechamber only via the at least one antechamber channel.

Clause 3: The breathing mask of clause 1 or 2, wherein the membrane outer space is formed by the membrane and at least partly by a covering cap.

Clause 4: The breathing mask of any of clauses 1-3, wherein, on inhalation, the membrane outer space is smaller in its maximum volume than the volume of the at least one antechamber.

Clause 5: The breathing mask of any of clauses 1-4, wherein the volume of the antechamber is in the range between 10 $cm^3$ and 30 $cm^3$, in particular between 10 $cm^3$ and 20 $cm^3$.

Clause 6: The breathing mask of any of clauses 1-5, wherein, in the region of the membrane outer space, the covering cap is airtight with respect to the surroundings.

Clause 7: The breathing mask of any of clauses 1-6, wherein the covering cap is part of the breathing valve or connectable with the same.

Clause 8: The breathing mask of any of clauses 1-7, wherein the at least one antechamber includes at least one exhalation opening to the surroundings.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

Some of the advantages and features of the preferred aspects or embodiments of the invention have been summarized herein above. These embodiments, along with other potential aspects or embodiments of the invention, will become apparent to those skilled in the art when referencing the following drawings in conjunction with the detailed descriptions as they relate to the figures.

DESCRIPTION OF THE INVENTION

Figure 1:
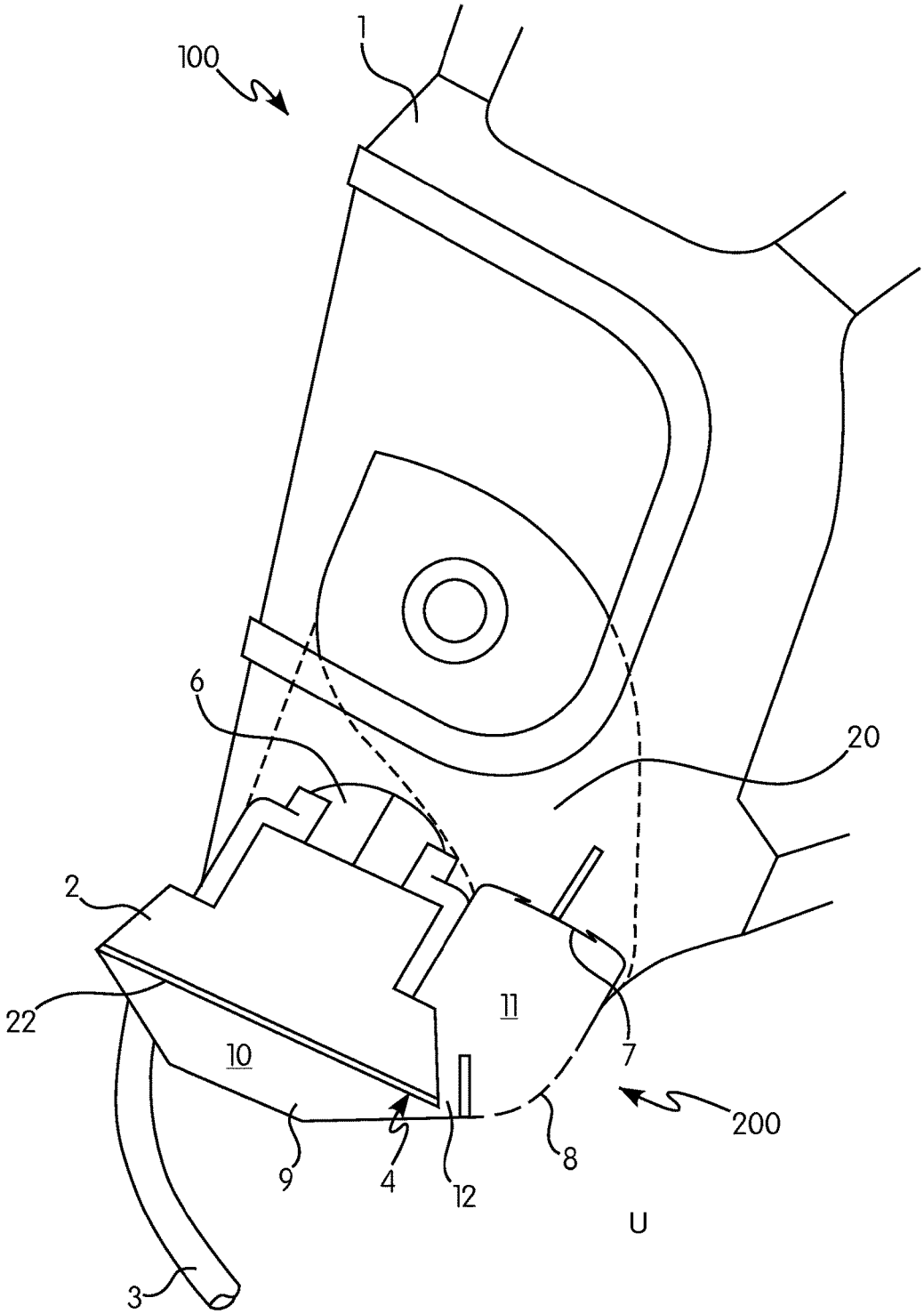
FIG. 1 is a schematic sectional view of one embodiment of a breathing mask according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step or stage sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

The present invention is directed to a breathing mask 100 and a flushing arrangement 200 for such a breathing mask 100, as illustrated in certain preferred and non-limiting embodiments or aspects and in schematic form in FIGS. 1-4.

With reference to FIG. 1, and in one preferred and non-limiting embodiment or aspect, the breathing mask 100 includes a mask body 1 having an inner area 20 in which the user's face is positioned. Breathing gas, e.g., breathing air, is supplied from a gas supply (not shown), which is part of a compressed-air breathing apparatus (or self-contained breathing apparatus). In particular, breathing air is supplied to the inner area 20 from a pressure line 3, e.g., a medium-pressure line, and through a breathing valve 2.

The breathing valve 2 is configured to control (or throttle) the flow of breathing gas into the inner area 20 of the mask body 1. The breathing valve 2 is connected to the mask body 1 in a variety of known manners, e.g., frictional engagement, screw connections, plug connections, bayonet connections, and the like. An inhalation valve 6 is positioned in the connection region between the breathing valve 2 and the mask body 1, and this inhalation valve provides for one-way gas flow into the inner area 20 of the mask body 1.

Further, the breathing valve 2 includes a membrane 4 with an outer surface 22. In one preferred and non-limiting embodiment or aspect, this membrane 4 is flexible, movable, or deformable, such that the membrane 4 is configured to flex or deform between an initial position FIG. 1), an inhalation position (FIG. 2; during user inhalation), and an exhalation position (FIG. 3; during user exhalation).

The breathing mask 100 includes the flushing arrangement 200, which, in one preferred and non-limiting embodiment or aspect, has a flushing area 10 located or defined adjacent the outer surface 22 of the membrane 4. Further, at least one exhalation chamber 11 is provided and configured to receive exhaled air from the inner area 20 of the mask body 1 of the breathing mask 100. At least one channel 12 fluidly connects the flushing area 10 and the at least one exhalation chamber 11. In operation, and during user inhalation (FIG. 2), air from the at least one exhalation chamber 11 flows through the at least one channel 12 into the flushing area 10 as a result of the inhaled air following the path A-B-C, i.e., through the pressure line 3, the breathing valve 2, and the inhalation valve 6 into the inner area 20. In operation, and during user exhalation (FIG. 3), air from the flushing area 10 flows through the at least one channel 12 into the at least one exhalation chamber 11 as a result of the exhaled air following the path D-E-G, i.e., through at least one exhalation valve 7 (configured to facilitate one-way airflow from the inner area 20), through the at least one exhalation chamber 11, and to the outside environment (U) (via at least one exhalation opening 8). The flushing arrangement 200 may also be configured in an airtight manner, such that the exhaled air is only capable of exiting the breathing mask 100 via the at least one exhalation opening 8 and in to the outside environment (U).

In this manner, a pendular flow (F) is created between the at least one exhalation chamber 11 and the flushing area 10 through the at least one channel 12. In particular, at least a portion of the exhaled air alternates between the at least one exhalation chamber 11 and the flushing area 10. It is envisioned that a plurality of exhalation chambers 11, which may or may not have different volumes and/or shared volumes, can also be provided and positioned in fluid communication with the flushing area 10.

In one preferred and non-limiting embodiment or aspect, the flushing area 10 is defined by at least a portion of the outer surface 22 of the membrane 4 and at least a portion of a cover 9 (or cap). This cover 9 may be integral with or connectable to at least a portion of the breathing valve 2 of the breathing mask 100. Further, the cover 9 serves to protect the membrane 4 and shields the flushing area 10 from the outside environment (U).

As discussed above, and in one preferred and non-limiting embodiment or aspect where the membrane 4 is flexible or deformable (and therefore, moves between the initial position, the inhalation position, and the exhalation position), the flushing area 10 has a variable volume. Accordingly, the volume of the flushing area 10 when the membrane 4 is in the inhalation position (FIG. 2) is greater than the volume of the flushing area 10 when the membrane 4 is in the initial position (FIG. 1), and the volume of the flushing area 10 when the membrane 4 is in the exhalation position (FIG. 3) is smaller than the volume of the flushing area 10 when the membrane 4 is in the initial position.

Figure 2:
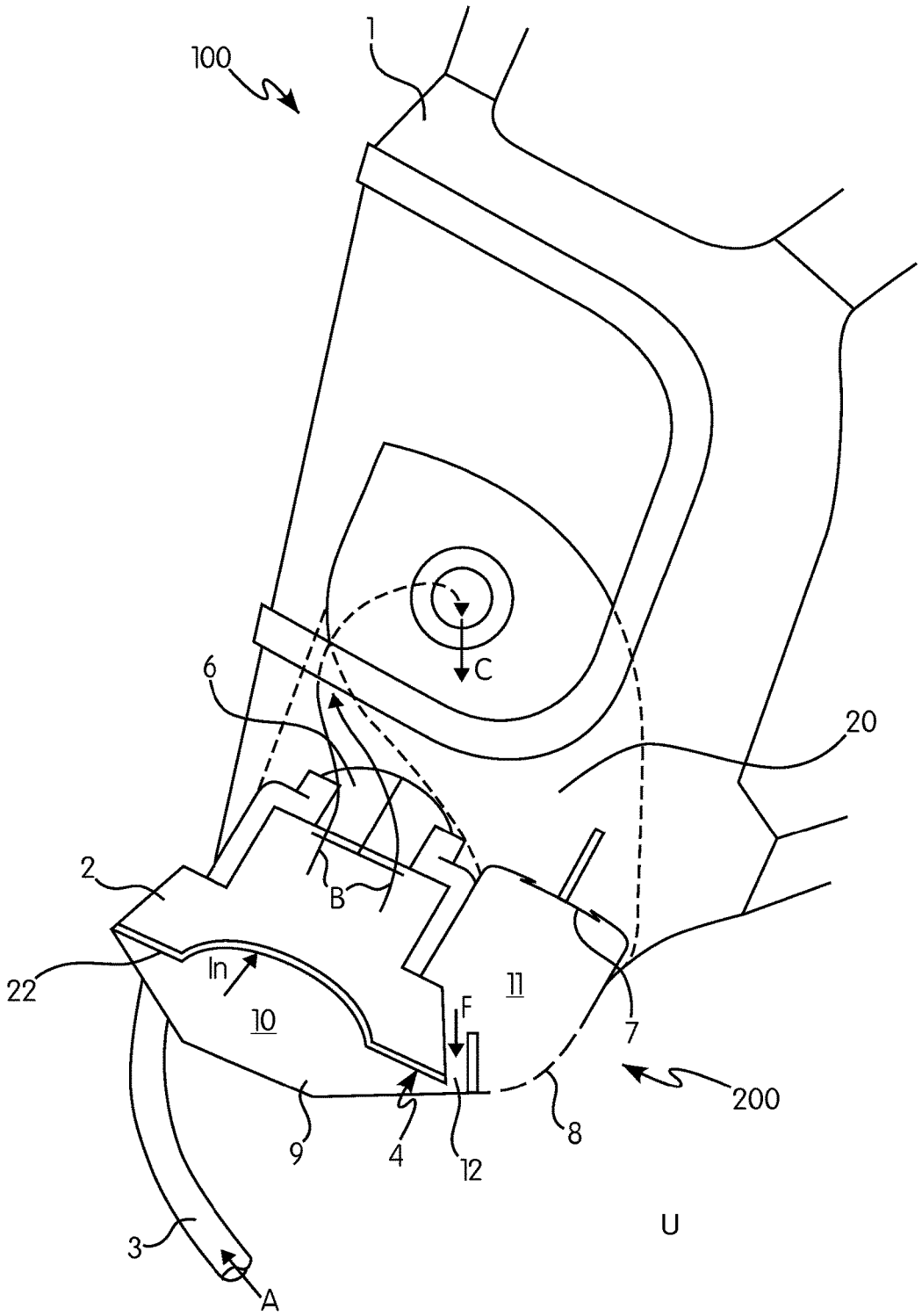
FIG. 2 is a schematic sectional view of the breathing mask of FIG. 1 during user inhalation.
Figure 3:
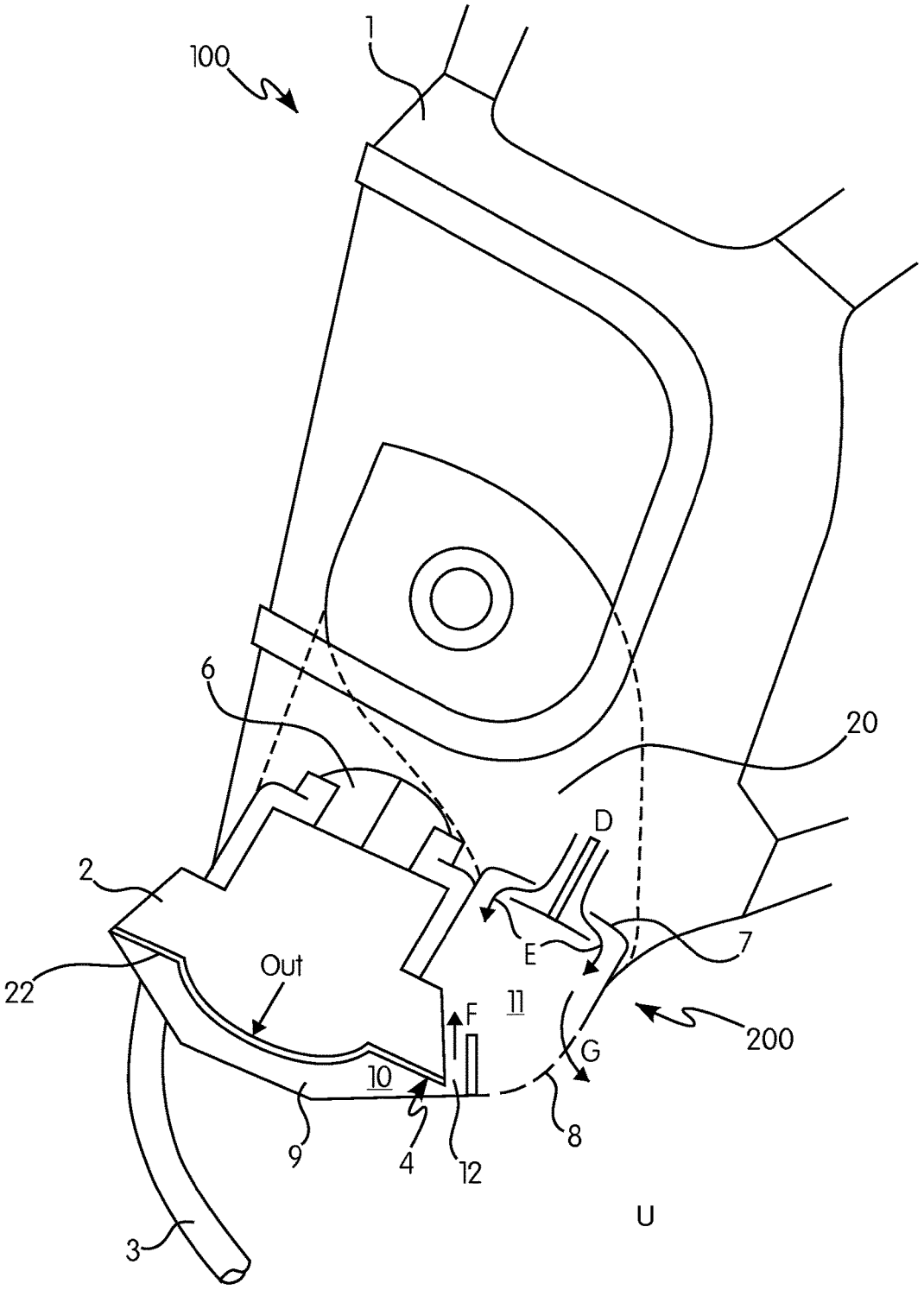
FIG. 3 is a schematic sectional view of the breathing mask of FIG. 1 during user exhalation.

With reference to FIG. 2, which illustrates user inhalation, when the membrane 4 moves or flexes "in", i.e., from the initial position to the inhalation position (or towards the direction of the inhalation valve 6), the volume of the flushing area 10 increases. Accordingly, and during user inhalation, airflows from the at least one exhalation chamber 11 to the flushing area 10, as represented by arrow F. With reference to FIG. 3, which illustrates user exhalation, when the membrane moves or flexes "out", i.e., from the initial position (as the membrane 4 transitions from the inhalation position), the volume of the flushing area 10 decreases. Accordingly, and during user exhalation, airflows from the flushing area 10 to the at least one exhalation chamber 11, as represented by arrow F. This pendular (or back-and-forth) airflow over the membrane 4 serves to flush or ventilate the membrane 4 using exhaled air, as opposed to the use of air from the outside environment (U).

In order to improve airflow and ventilation, and in one preferred and non-limiting embodiment or aspect, the volume of the flushing area 10 when the membrane 4 is in the inhalation position is smaller than the volume of the at least one exhalation chamber 11, i.e., the volume of at least one exhalation chamber 11 is always greater than the volume of the flushing area 10. This volume differential beneficially enhances airflow and ventilation in the flushing area 10. In one preferred and non-limiting embodiment or aspect, the volume of the at least one exhalation chamber 11 is in the range of about 10 $cm^3$ to about 30 $cm^3$, and in another preferred and non-limiting embodiment or aspect, the volume of the at least one exhalation chamber 11 is in the range of about 10 $cm^3$ to about 20 $cm^3$.

Figure 4:
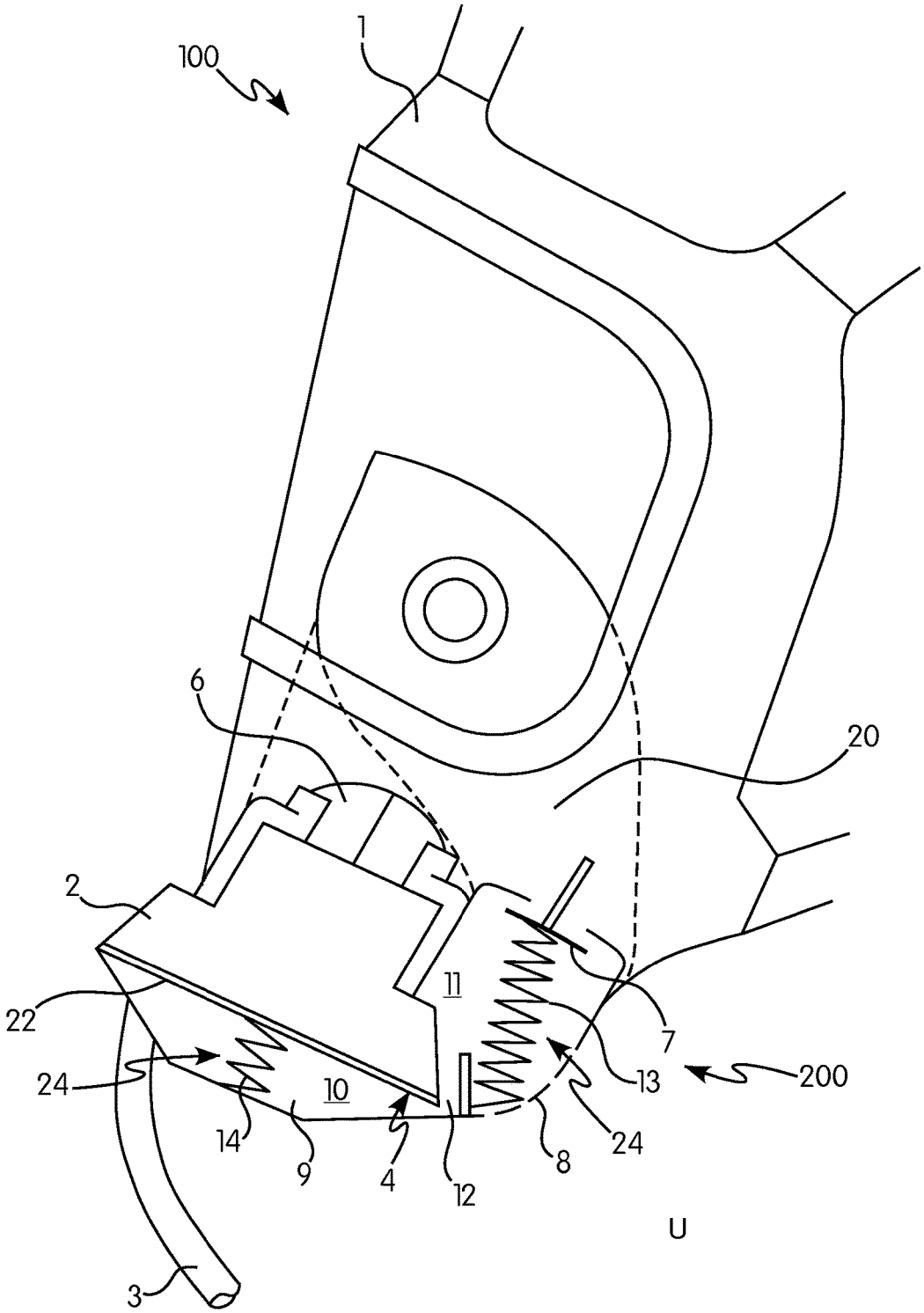
FIG. 4 is a schematic sectional view of another embodiment of a breathing mask according to the principles of the present invention.

In one preferred and non-limiting embodiment or aspect, and as illustrated in FIG. 4, the breathing mask 100 and flushing arrangement 200 include at least one tensioning element 24 referred to collectively as "tensioning elements 24"). Tensioning elements 24 may be arranged or configured to urge against, e.g., pretension, urge in a specified direction, and the like, certain elements of the breathing mask 100 and/or flushing arrangement 200. Such an arrangement provides for increased air pressure to be maintained in the inner area 20 of the mask body 1 of the breathing mask 100. In one preferred and non-limiting embodiment or aspect, a first tensioning element 13 and a second tensioning element 14 are provided, where the first tensioning element 13 urges the exhalation valve 7 into a closed or sealed position, and the second tensioning element 14 urges the membrane 4 towards the "in" or inhalation position.

For purposes of summarizing the invention, certain aspects, features and advantages of the invention have been described. It is herein to be understood that not all advantages of this invention can be achieved in relation to any particular embodiment. As such, the invention can be embodied in configurations to optimize one or various advantages. Applications of the invention can be indicated for any one advantage, or combination of advantages, as indicated for implementation.

While several embodiments of the breathing mask and flushing arrangement are shown in the accompanying figures and described hereinabove in detail, other embodiments will be apparent to, and readily made by, those skilled in the art without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive.

What is claimed is:

1. A breathing mask, comprising:

a mask body having an inner area;

a breathing valve configured to control the flow of breathing gas into the inner area of the mask body, the breathing valve comprising a membrane having an outer surface; and a flushing arrangement, comprising:

(i) a flushing area located adjacent the outer surface of the membrane;

(ii) at least one exhalation chamber configured to receive exhaled air from the inner area of the breathing mask; and (iii) at least one channel fluidly connecting the flushing area and the at least one exhalation chamber;

wherein the flushing area and the at least one exhalation chamber are arranged such that, during user inhalation, exhaled air from the at least one exhalation chamber flows through the at least one channel into the flushing area in a first direction, and during user exhalation, the exhaled air from the flushing area flows through the at least one channel into the at least one exhalation chamber in a second direction different from the first direction and opposite to a direction of exhalation through an exhalation valve in order to exit the breathing mask, and wherein the flushing area is flushed with the exhaled air during user inhalation and user exhalation.

2. The breathing mask of claim 1, wherein the membrane is flexible or deformable and configured to flex or deform between an initial position, an inhalation position, and an exhalation position.

3. The breathing mask of claim 2, wherein the volume of the flushing area when the membrane is in the inhalation position is greater than the volume of the flushing area when the membrane is in the initial position.

4. The breathing mask of claim 2, wherein the volume of the flushing area when the membrane is in the exhalation position is smaller than the volume of the flushing area when the membrane is in the initial position.

5. The breathing mask of claim 2, wherein the volume of the flushing area when the membrane is in the inhalation position is smaller than the volume of the at least one exhalation chamber.

6. The breathing mask of claim 1, further comprising at least one tensioning element configured to urge against at least one of the following: the membrane, at least one exhalation valve configured to facilitate one-way airflow from the inner area of the breathing mask into the at least one exhalation chamber, or any combination thereof.

7. The breathing mask of claim 1, wherein the flushing area is defined by at least a portion of the outer surface of the membrane and at least a portion of a cover.

8. The breathing mask of claim 1, further comprising at least one exhalation valve configured to facilitate one-way airflow from the inner area of the breathing mask into the at least one exhalation chamber.

9. The breathing mask of claim 1, wherein the exhalation chamber further comprises at least one exhalation opening through which exhaled air in the exhalation chamber flows to an outside environment.

10. A flushing arrangement for a breathing mask having a breathing valve with a membrane for controlling inhalation and exhalation, the flushing arrangement comprising:

a flushing area located adjacent an outer surface of the membrane;

at least one exhalation chamber configured to receive exhaled air from the breathing mask; and at least one channel fluidly connecting the flushing area and the at least one exhalation chamber;

wherein the flushing area and the at least one exhalation chamber are arranged such that, during user inhalation, exhaled air from the at least one exhalation chamber flows through the at least one channel into the flushing area in a first direction, and during user exhalation, the exhaled air from the flushing area flows through the at least one channel into the at least one exhalation chamber in a second direction different from the first direction and opposite to a direction of exhalation through an exhalation valve in order to exit the breathing mask, and wherein the flushing area is flushed with the exhaled air during user inhalation and user exhalation.

11. The flushing arrangement of claim 10, wherein the flushing area is defined by at least a portion of the outer surface of the membrane and at least a portion of a cover.

12. The flushing arrangement of claim 11, wherein the cover is integral with or connectable to at least a portion of the breathing valve of the breathing mask.

13. The flushing arrangement of claim 10, wherein the membrane is flexible or deformable and configured to flex or deform between an initial position, an inhalation position, and an exhalation position.

14. The flushing arrangement of claim 13, wherein the volume of the flushing area when the membrane is in the inhalation position is greater than the volume of the flushing area when the membrane is in the initial position.

15. The flushing arrangement of claim 13, wherein the volume of the flushing area when the membrane is in the exhalation position is smaller than the volume of the flushing area when the membrane is in the initial position.

16. The flushing arrangement of claim 13, wherein the volume of the flushing area when the membrane is in the inhalation position is smaller than the volume of the at least one exhalation chamber.

17. The flushing arrangement of claim 10, further comprising at least one tensioning element configured to urge against at least one of the following: the membrane, at least one exhalation valve configured to facilitate one-way airflow from an inner area of the breathing mask into the at least one exhalation chamber, or any combination thereof.

18. The flushing arrangement of claim 10, further comprising at least one exhalation valve configured to facilitate one-way airflow from an inner area of the breathing mask into the at least one exhalation chamber.

19. The flushing arrangement of claim 10, wherein the exhalation chamber further comprises at least one exhalation opening through which exhaled air in the exhalation chamber flows to an outside environment.

20. The flushing arrangement of claim 10, wherein the volume of the at least one exhalation chamber is in the range of about 10 $cm^3$ to about 30 $cm^3$.

* * * * *